US006062724A

United States Patent [19]

Habicht

[11] Patent Number: 6,062,724

[45] Date of Patent: May 16, 2000

[54] CLAMP FOR RETAINING A REMOVABLE FRAME ON A LIFTING APPARATUS FOR MATERIAL HANDLING EQUIPMENT

[76] Inventor: Helmut Habicht, 39 W. Wildwood, Saddle River, N.J. 07458

[21] Appl. No.: 09/235,870

[22] Filed: Jan. 22, 1999

[51] Int. Cl.[7] ..... B01F 15/00; B01F 9/00

[52] U.S. Cl. ..... 366/209; 366/213; 366/218

[58] Field of Search ..... 366/209, 208, 366/213, 214, 218, 219, 197; 414/401, 402; 248/229.1, 229.11, 228.2, 221.12

[56] References Cited

U.S. PATENT DOCUMENTS

| | | | |
|---|---|---|---|
| 5,107,878 | 4/1992 | Young | 366/213 |
| 5,123,747 | 6/1992 | Derksen | 366/213 |
| 5,338,114 | 8/1994 | Steele | 366/218 |
| 5,516,207 | 5/1996 | Habicht | 366/228 |

*Primary Examiner*—Tony G. Soohoo
*Attorney, Agent, or Firm*—Patrick J. Pinto

[57] ABSTRACT

A clamp assembly that is mounted to a carriage assembly of a lifting apparatus. The carriage assembly is adapted for linear and rotational movement with respect to a column of the lifting apparatus. The carriage assembly includes a pair of lifting forks that are spaced for mating with a pair of apertures formed in a support frame assembly of an article to be lifted. The clamp assembly includes an L-shaped locking arm that is arrayed for both angular movement and a biased linear movement with respect to the carriage assembly. The angular movement being selectively moved between an engaged position and a disengaged position by a manual or powered actuator. The engaged position retains the support frame assembly on the carriage assembly when and while the lifting forks are mated with the pair of apertures. The disengaged position allowing removal of the support frame from the forks.

19 Claims, 6 Drawing Sheets

CLAMP FOR RETAINING A REMOVABLE FRAME ON A LIFTING APPARATUS FOR MATERIAL HANDLING EQUIPMENT

CROSS REFERENCE TO RELATED APPLICATIONS

Not Applicable

STATEMENT REGARDING FEDERALLY SPONSORED RESEARCHE OR DEVELOPMENT

Not Applicable

BACKGROUND OF THE INVENTION

1. Field of the Invention

With regard to the classification of art, this invention is believed to be found in the general class entitled Material or Article Handling and more particularly to those subclasses pertaining to clamping a frame of a removable mixing or blending chamber that rotates relative to a support.

2. Description of Related Art Including Information Disclosed Under 37 CFR 1.97 and 1.98

Lifting apparatus for holding and lifting a frame of a removable blending chamber bin, or container are known in the prior art. One known example of the prior art is U.S. Pat. No. 5,516,207 that issued to the present inventor on May 14, 1996 and is solely owned by him. This prior art method and apparatus associated therewith have been very successful in industry. However, in some material handling or blending situations, it has been determined that there is a need for improvement to the equipment and process disclosed in that prior art patent. It has been found that there is a need to more accurately locate and hold the blending bin with respect to the lifting apparatus during all phases of the blending operation. This desired and newly identified need requires that the blending container or bin be accurately and consistently placed and retained on the lifting apparatus during all phases of the process. This desired need will reduce the need for manual adjustments thereof and thereby ultimately increasing efficiency and productivity.

The present invention solves the above identified need by including at least one clamping means that is arrayed for accurately positioning and retaining like support frames of removable blending bins or containers on a pair of forks of the material handling apparatus.

In one example, the present invention is selectively actuable by an operator for engaging a support frame of an article to be lifted and includes a biasing means for retention of a frame of that article.

In an alternate example the present invention is selectively actuable simultaneously with the rotation of at least one of a pair of non-circular forks. However the present invention also allows for the independent actuation of the clamping means and the rotation of the fork members.

The blending bin or container is removable from the lifting apparatus and is adapted for accurate placement and retention thereon. This allows for alignment of similarly configured articles to be accurately positioned over a supply port of a processing or forming machine.

SUMMARY OF THE INVENTION

The present invention may be briefly described as: a clamp for positioning and retaining a removable frame to a lifting carriage of a lifting apparatus including:

a) a lifting carriage being arrayed for selective linear movement by a lifting apparatus, the lifting carriage further including a pair of forks that are arrayed in spaced relationship for mating with a pair of apertures formed in a support frame assembly of an article to be lifted;

b) at least one clamping assembly being carried by and with the lifting carriage, the clamping assembly further including a locking arm, an actuator means, and a biasing means; and wherein the locking arm being selectively moved from a disengaged position to an engaged position by the actuator means, the disengaged position being arrayed for allowing selective movement of the support frame assembly onto and off of the lifting forks, the engaged position being arrayed for positively locating and retaining the support frame assembly on the lifting carriage when and while the forks are mating with the apertures of the support frame assembly.

The clamping assembly may further include a stop block that positively positions the support frame assembly with respect to the carriage assembly.

The clamping assembly may be selectively moved between the engaged position and the disengaged position by an actuator means that is commonly used for rotating an adjacent fork member.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode of the present invention. These specific embodiments, as shown in the accompanying drawings, may also include diagrammatic symbols for the purpose of illustration and understanding.

BRIEF DESCRIPTION OF THE SEVERAL VIEW OF DRAWINGS

Figure 5:
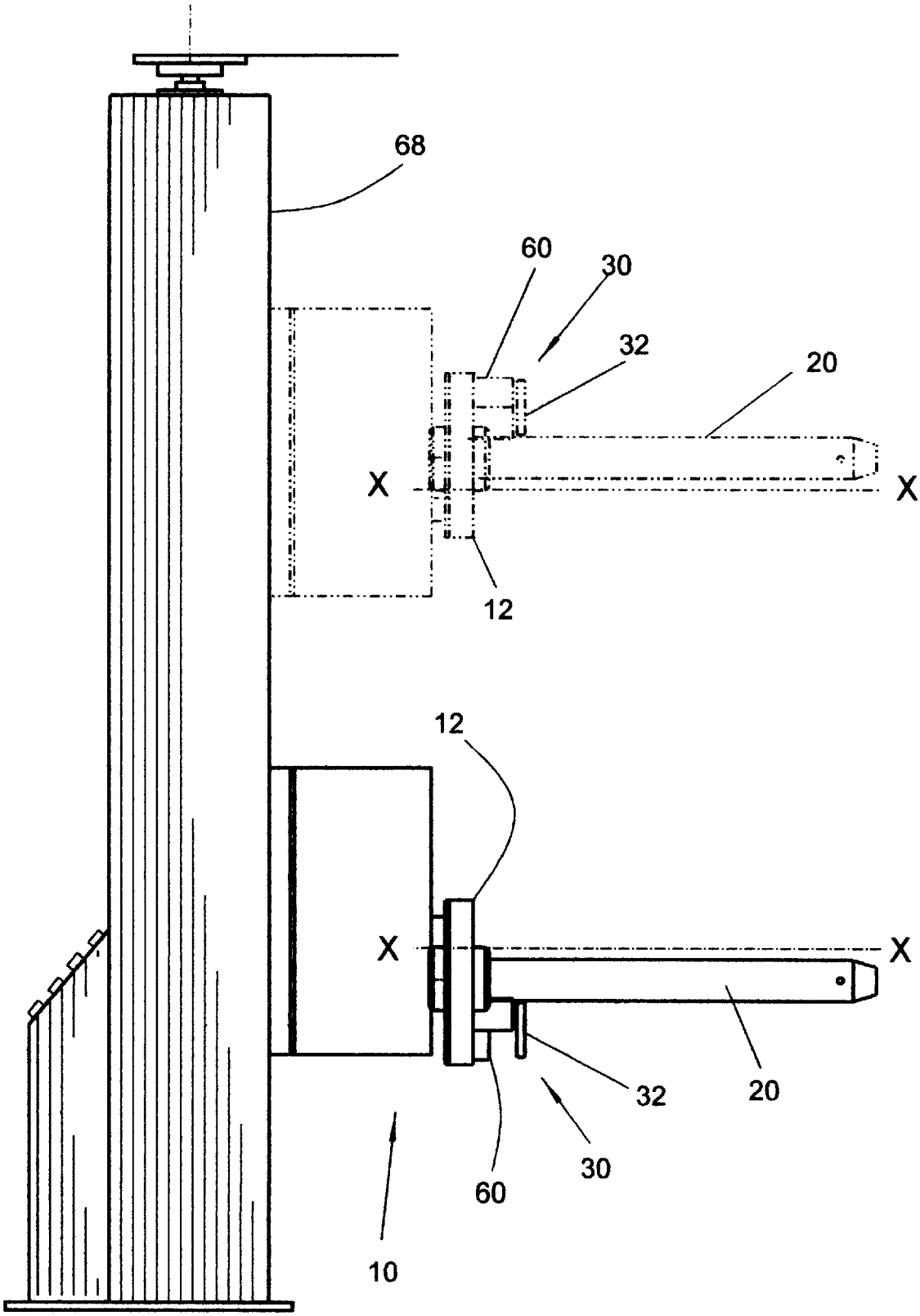

FIG. 5. represents a side elevation of a lifting apparatus, an alternate elevated and inverted position of a carriage member being shown in dashed outline.

Figure 6:
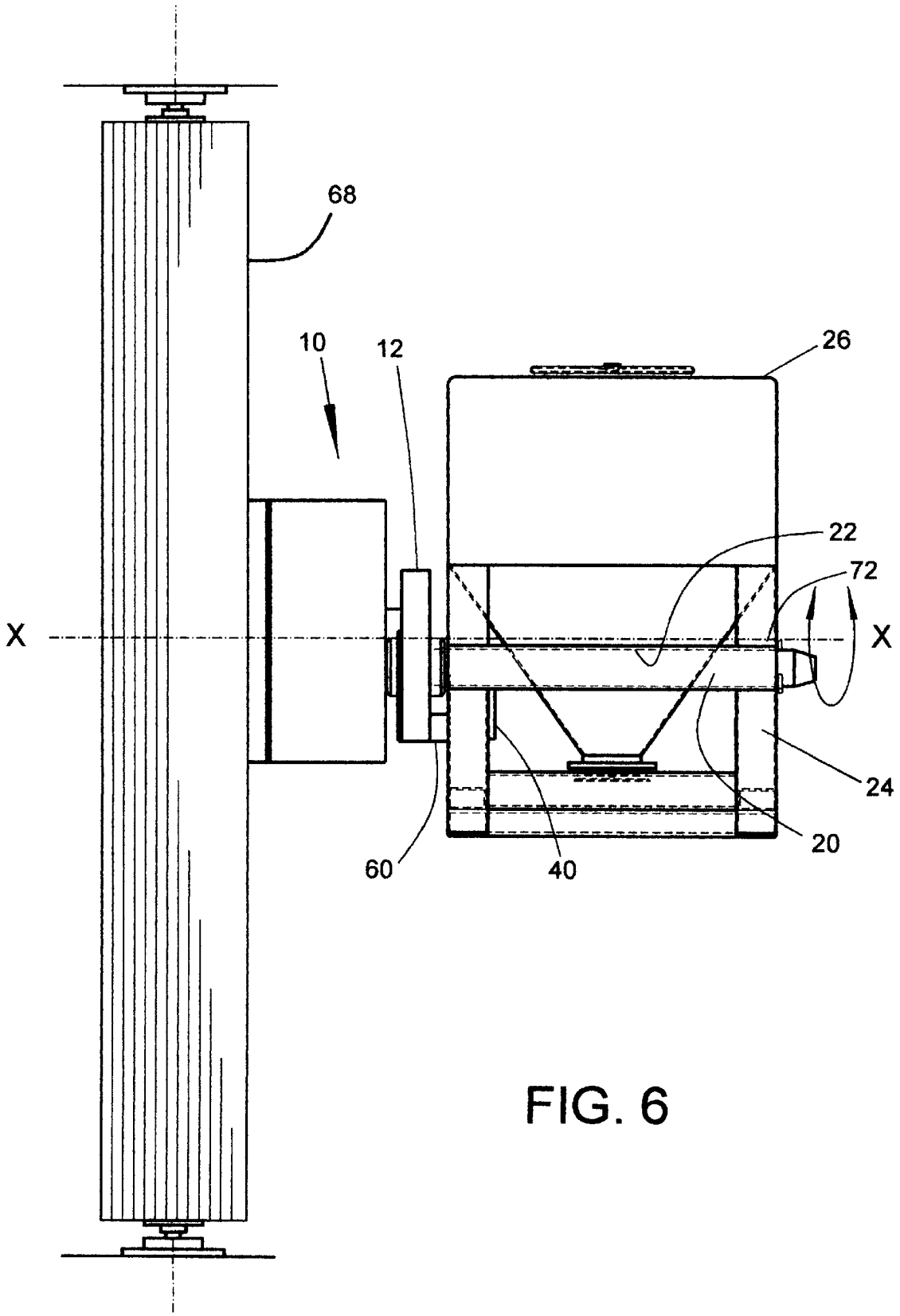

FIG. 6 represents a side elevation, of the lifting apparatus of FIG. 5 with a typical article being lifted.

Figure 7:
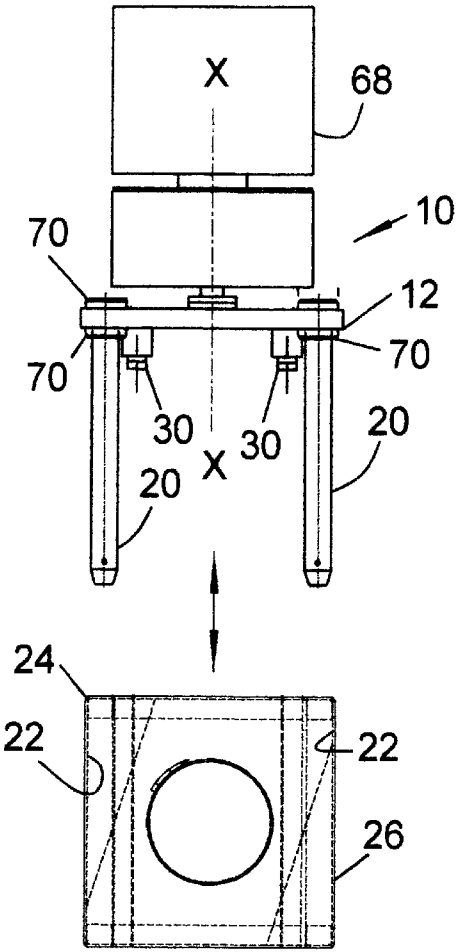

FIG. 7 represents a plan view in a reduced scale, this view showing one example of the article to be lifted prior to placement on the lifting apparatus.

Figure 8:
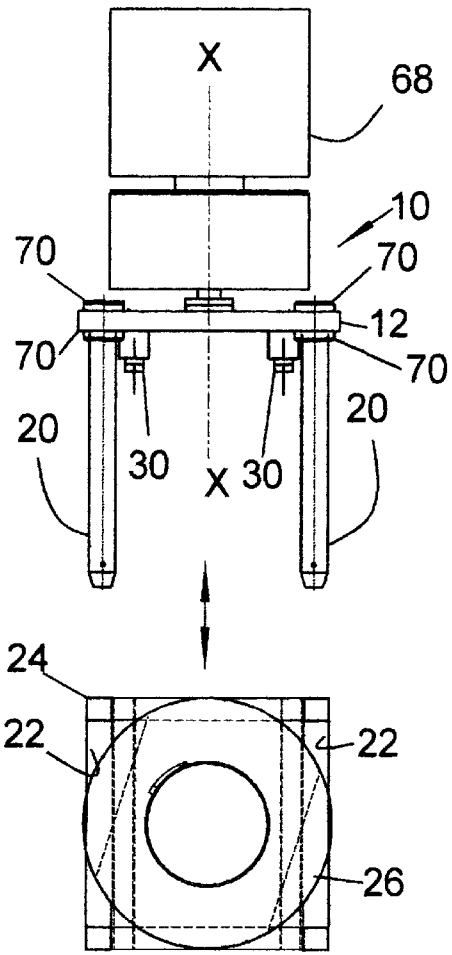

FIG. 8 represents a plan view in a reduced scale, this view showing a second example of the article to be lifted prior to placement on the lifting apparatus.

Figure 9:
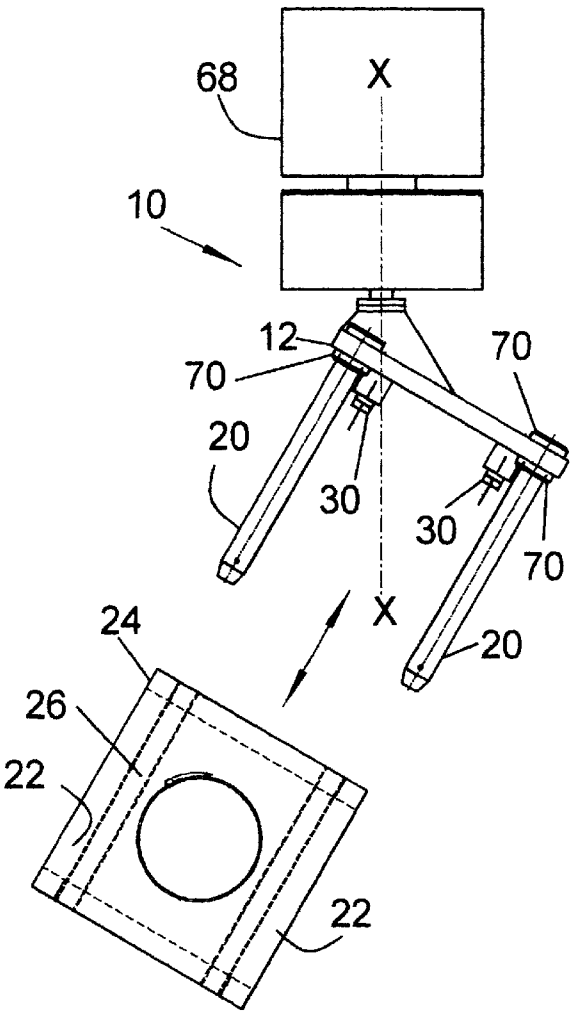

FIG. 9 represents a plan view in a reduced scale, this view showing a lifting apparatus and an article to be lifted, this view showing an axis for the pair of lifting forks being angularly displaced from X—X axis of the lifting apparatus.

In the following description and in the appended claims, various components are identified by specific names for convenience. These names are intended to be generic in their application while differentiating between the various components. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 1:
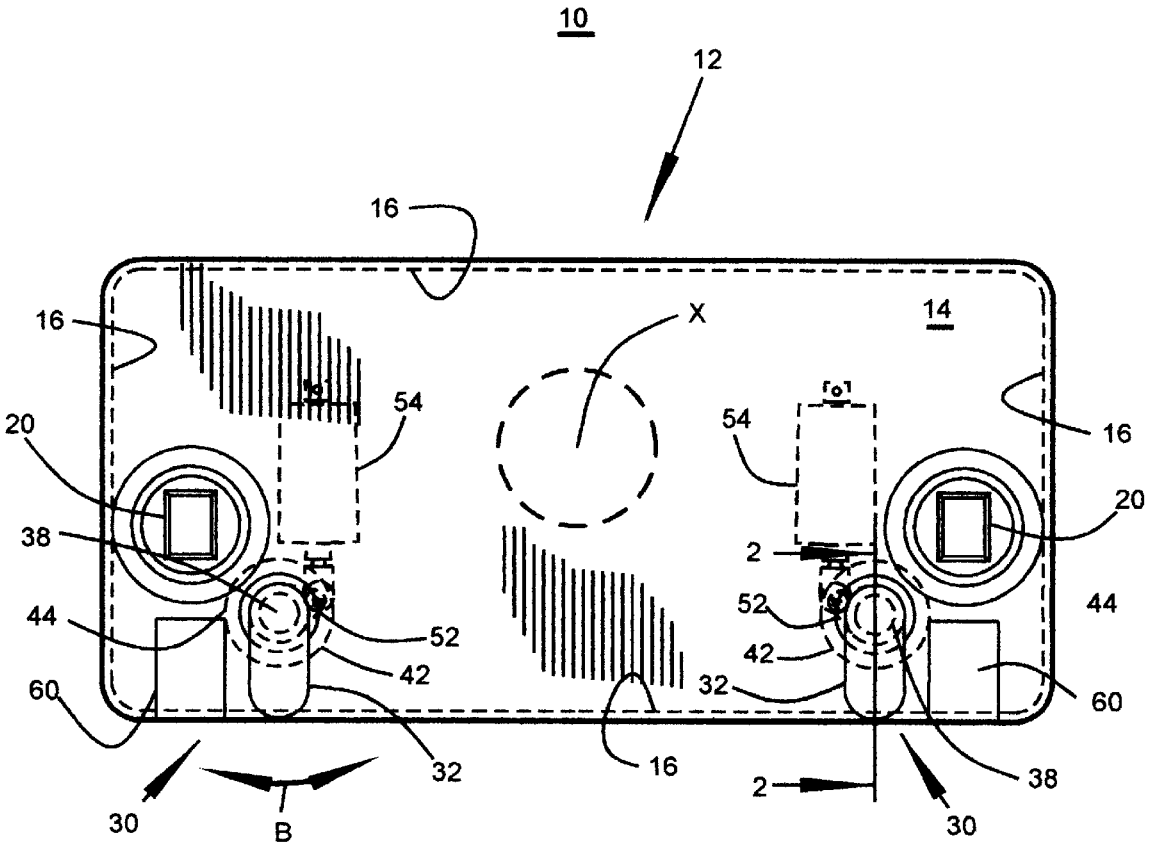
FIG. 1 represents a front side elevation of one embodiment of the present invention.
Figure 2:
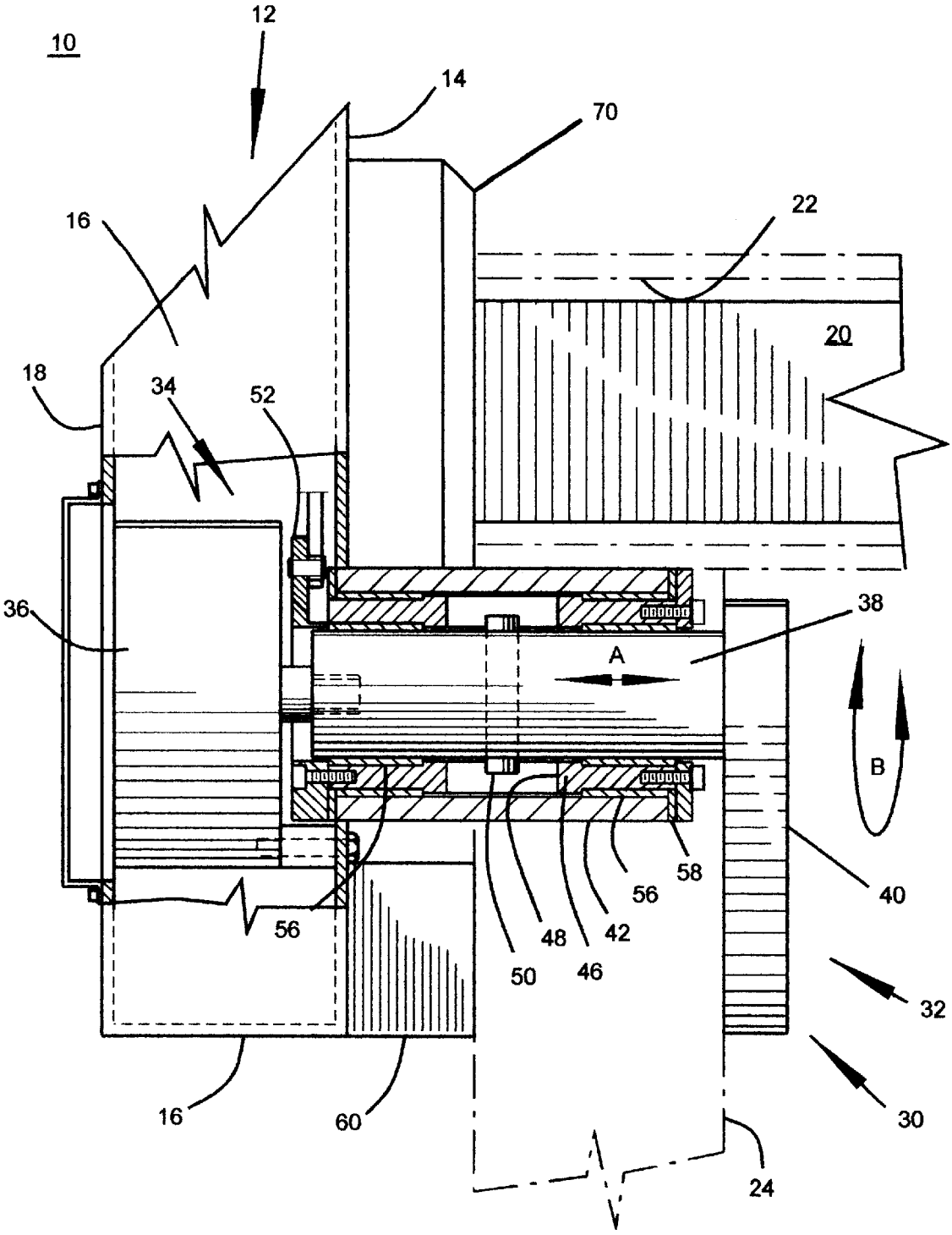
FIG. 2 represents a left side elevation of the present invention, this view, in an enlarged scale, being partly in section and being taken along line 2—2 of FIG. 1.

Referring to the drawings and in particular to FIGS. 1, and 2, one embodiment of the present invention is shown. A lifting carriage assembly is generally identified as 10. Preferably this lifting carriage assembly 10 includes a housing 12 that includes a front wall 14, a plurality of peripheral walls 16 and a rear wall 18. It is preferred that the housing 12 be of a corrosion resistant material and all joints, apertures, penetrations, removable access covers, and the like be gasketed or sealed to minimize the entry and/or escapement of unwanted materials or substances there into or therefrom. The sealed integrity of the housing is very important in pharmaceutical and/or food processing industries where contamination of the process environment is not tolerable. The lifting carriage assembly 10 further includes a pair of fork members 20 that are usually mounted in cantilever fashion as may be more clearly seen in FIGS. 5 through 9. It is preferred that the fork members 20 be sized and spaced to mate with a pair of elongated apertures 22. The apertures 22 are formed in a support frame assembly 24 of an article 26 to be lifted such as a blending bin, container, and the like. It must be noted that the fork members 20 and the mounting thereof must be of a sufficient size and strength for satisfying a design or assumed loading. The housing 12 may also require reinforcing means, not shown, for satisfying and carrying the design or assumed loading.

Referring again to FIGS. 1 and 2, the lifting carriage assembly 10 further includes a clamping assembly that is generally identified as 30. The clamping assembly 30 is carried by and moves with the lifting carriage assembly 10. The clamping assembly 30 includes a locking arm 32, an actuation means 34, and a biasing means 36. It is preferred that the locking arm 32 be arrayed in an L-shape to form a stem portion 38 and a locking leg 40. The locking arm 32 is carried by a mounting block 42 that allows angular and linear movement as depicted by arrows "A" & "B". The angular and the linear movement may take place independently or simultaneously. The linear movement "A" is preferably urged to the left, to a clamped position, by a biasing means 36 that is connected to the stem portion 38. It is preferred that the biasing means 36 also be housed within an enclosure or frame for ease of assembly as a unit to the housing 12. Some examples of a biasing means 36 are a compression spring, an air spring and the like. It is preferred that the biasing means 36 be a first linear actuator, such as pancake cylinder, that is adjustably powered by a fluid in at least the direction of clamping, to the left. A selectively powered biasing means 36, such as a double acting cylinder, will allow independent and selective linear movement "A" of the locking leg 40 prior to or after rotation thereof, in the direction of arrow "B".

Referring in particular to FIG. 2, one example of the mounting arrangement of the locking arm 32 in the mounting block 42 includes a tubular sleeve member 46 that has at least one elongated keyway 48 formed therein. Preferably, the sleeve member 46 is formed to have two opposed keyways 48. This arrangement is preferred for loading consideration as well as for ease of assembly and service. A key member 50, in the form of a pin such as a dowel and the like, is press fit into the stem portion 38 with at least one extending portion for engaging at least one of the keyways 48. The sleeve 46 is removably attached to an actuating lever 52 of the actuation means 34. This actuating lever 52 preferably is connected to a second linear actuator 54 by a clevis arrangement. Preferably, the second linear actuator 54 is pivotally mounted to the interior of the housing 12 and housed therein. The second linear actuator 54 is preferably a fluid powered double acting cylinder. However the actuator means 34 may include a manually operated lever, toggle clamp and the like that is mounted exterior of the housing 12 when environmental and processing conditions permit.

The clamping assembly 30 further includes a plurality of sleeve bearings 56 and thrust bearings 58 arrayed within the mounting block 42 for allowing the rotational movement of the sleeve member 46 which in turn rotates the stem 38 in the direction of "B" by way of the key 50 and keyway 48 arrangement. The keyway 48 is elongated a sufficient length for allowing a predetermined amount of linear movement "A" for the locking arm 32. The mounting arrangement depicted in FIG. 2 is preferred in applications that are environmentally sensitive to contamination. However, in applications that permit the possibility of lubricant contamination the mounting block and the components associated therewith may be replaced by and with a pneumatic or hydraulic cylinder.

The clamping assembly 30 should also include a stop block 60 that is also carried by the carriage assembly 10. The stop block 60 may be either permanently or removably attached to the carriage assembly 10 by welding, suitable fasteners and the like. The predetermined space or gap between the front wall 14 and the support frame assembly 24 may be selectively modified or adjusted by either replacing the removably attached stop block 60 or by adding additional spacers or blocks to a permanently attached stop block. This allows like size articles to be consistently aligned with associated processing equipment.

Figure 3:
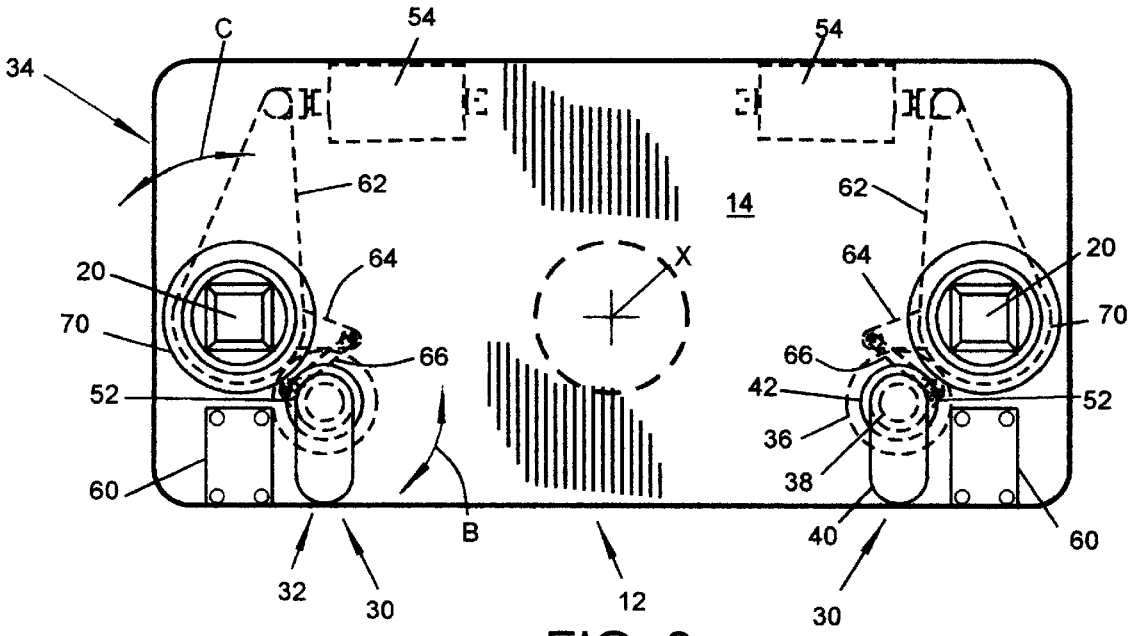
FIG. 3 represents a front side elevation of an alternate embodiment of the present invention, this view showing the present invention in a disengaged position.
Figure 4:
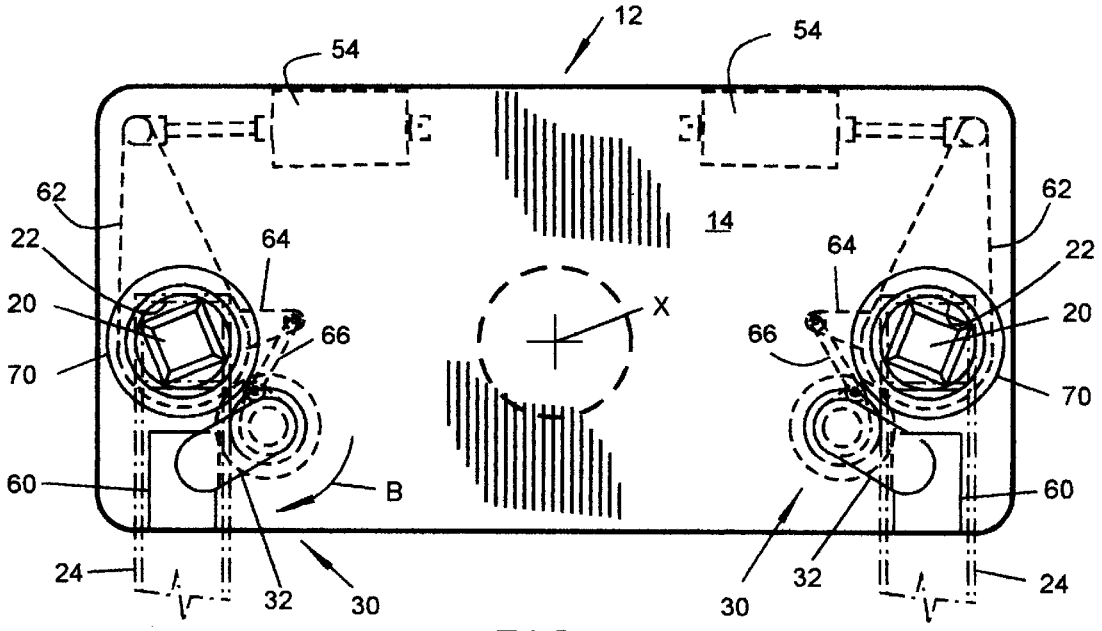
FIG. 4 represents a front side elevation of the alternate embodiment of FIG. 3, this view showing the present invention an engaged position.

Referring in particular to FIGS. 3 and 4, an alternate embodiment of the present invention is shown. In this alternate embodiment, the lifting carriage assembly 10 of FIGS. 1 and 2 further includes at least one rotatable fork member 20 that engages the elongated aperture 22 of the support frame assembly 24 of an article to be lifted. The actuation of the rotatable fork member is by way of a second linear actuator 54 in cooperation with a pivoting first lever or crank member 62. The first lever or crank 62 pivots in the direction of arrow "C". The first lever 62 operates a second lever 64. The second lever moves the clamping assembly in the direction of arrow "B" by way of a connecting rod assembly 66. In this alternate embodiment the connecting rod assembly may include an adjustment means for making relative angular positioning adjustments. In this alternate embodiment the second linear actuator 54 also selectively moves the locking arm 32 of the clamping assembly 30 between a disengaging position as seen in FIG. 3 to an engaging position a seen in FIG. 4. In the engaging position the support frame assembly 24, shown in dashed outline, is retained by the clamping assembly 30 and the rotation of the forks member 20 interior of the elongated aperture 22. This occurs simultaneously as and when either of the fork members is rotated from a loading/unloading position, seen in FIG. 3 to an locking position as seen in FIG. 4.

Additional details, use and operation of rotatable fork members 20 with respect to the elongated aperture 22 have been previously disclosed in U.S. Pat. No. 5,516,207 that issued to the present inventor and is incorporated herein to this disclosure. It is to be noted that the rotatable fork members 20 must have a non-circular cross-section, such as oval, polygon etc. for proper operation thereof. As previously noted, the housing 12 must include journals 70 for any rotatable fork member 20. Those journals 70 must be sized for handling the design or assumed load.

It is also to be noted that rotation of any fork member 20 and any clamping assembly 30 may be independently actuated by separate and individual actuating means. This arrangement would allow the retrofitting of any lifting apparatus having a rotatable fork system with the clamping assembly 30 of the present invention.

USE AND OPERATION

Referring now to FIGS. 1 through 9, the present invention is intended for use with an article 26 such as a blending bin, container or the like that is removable from fork members 20 that are carried by a lifting carriage assembly 10 of a lifting apparatus 68. The lifting apparatus 68 is arrayed for selectively lifting or elevating the article 26 then rotating the article about axis X—X. An elevated and rotated position of the carriage assembly 10 is depicted in dashed outline in FIG. 5. A major axis of the fork members 20 are usually substantially parallel to each other. However, in some blending applications the major axis of the fork members may either be parallel to the axis X—X as seen in FIGS. 7 and 8 or angularly displaced as seen in FIG. 9. The article 26 positioned on the forks of the apparatus of FIG. 9 travels in an orbital path around the X—X axis. The blending container of the article 26 may have various shapes, such as round, rectangular, square, and the like.

The clamping assembly is placed in a disengaging position similar to FIGS. 1 and 3. The article 26 is usually placed on the fork members 20 so that the fork members 20 are inserted into elongated apertures 22 formed in the support frame assembly 24 of the article 26. The support frame 24 may be moved either by way of integrally mounted dollies or wheels, not shown, or by a commercially available pallet truck. The article is positioned on the fork members 20 so that the support frame assembly 24 contacts a face of the stop block 60. The clamping assembly of the first embodiment or the alternate embodiment is rotated to an engaged position similar to FIG. 4. The locking leg 40 is moved to an abutted relationship with the support frame assembly by the biasing means 36 thereby providing a positive positioning and clamping means for the article 26. The movement of the clamping assembly 30 in the direction of arrows "A" and/or "B" may be selectively actuated by a machine operator or automated in response to position sensors.

It is preferred that a safety pin 72 be removably inserted into a mating hole of the fork member 20 in addition to the clamping arrangement of the first embodiment or the alternate embodiment of this invention. The safety pin 72 acts as a back-up safety device for use during the rotation and/or blending of the materials interior of the article 26. This back-up safety device is preferred in the event that any of the fluid or powering systems fail. Additional details, use and operation of the safety pin 72 have also been disclosed in U.S. Pat. No. 5,516,207 that has been noted above.

While the several embodiments of the present invention have been shown and described in connection with a lifting apparatus for clamping a blending bin or container, it is believed that the present invention may be used with other types of lifting and transporting machinery or equipment.

Directional terms such as "front", "back", "in", "out", "downward", "upper", "lower", "leftward", "rightward" and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A clamp for a lifting apparatus including:

a) a lifting carriage being arrayed for selective linear movement by a lifting apparatus, the lifting carriage further including a pair of forks that are arrayed in spaced relationship for mating with a pair of apertures formed in a support frame assembly of an article to be lifted;

b) at least one clamping assembly being carried by and with the lifting carriage, the clamping assembly further including a locking arm, an actuator means, and a biasing means; the biasing means being arrayed for urging a locking leg of the locking arm to and towards a clamped position; and wherein the locking arm being selectively moved from a disengaged position to an engaged position by the actuator means, the disengaged position being arrayed for allowing selective movement of the support frame assembly onto and off of the lifting forks, the engaged position being arrayed for retaining the support frame assembly in the clamped position on the lifting carriage when and while the forks are mating with the apertures of the support frame assembly.

2. An apparatus as recited in claim 1 wherein said biasing means further includes a pneumatic actuator for selectively moving the locking arm between the clamped position and an unclamped position.

3. An apparatus as recited in claim 2 wherein at least one fork of the pair of forks of the lifting apparatus being rotatably mounted to the lifting carriage of the lifting apparatus for selectively and simultaneously securing at least one of the apertures thereon and thereto.

4. An apparatus as recited in 3 wherein the actuator means further includes a linear actuator that is selectively powered and the fork and its associated locking arm are selectively and simultaneously operated by the actuator means for securing the support frame assembly thereon and thereto.

5. An apparatus as recited in 3 wherein the locking arm is L-shaped with one leg of the L-shaped locking arm being journalled in a housing member for allowing rotary movement of the other leg of the L-shaped locking arm between the engaged position and disengaged.

6. An apparatus as recited in claim 2 wherein at least one fork of the pair of forks of the lifting apparatus being rotatably mounted to the lifting carriage of the lifting apparatus for selectively and simultaneously securing at least one of the apertures thereon and thereto and each of the apertures being arrayed interior of an elongated support rail of the support frame assembly.

7. An apparatus as recited in 6 wherein the actuator means further includes a linear actuator that is selectively powered and the fork and its associated locking arm are selectively and simultaneously operated by the actuator means for securing the support frame assembly thereon and thereto.

8. An apparatus as recited in 6 wherein the locking arm is L-shaped with one leg of the L-shaped locking arm being journalled in a housing member for allowing rotary movement of the other leg of the L-shaped locking arm between the engaged position and disengaged.

9. An apparatus as recited in 2 wherein the locking arm is L-shaped with one leg of the L-shaped locking arm being journalled in a housing member for allowing rotary movement of the other leg of the L-shaped locking arm between the engaged position and disengaged.

10. An apparatus as recited in claim 2 wherein said article to be lifted is a container for selectively blending and dispensing of flowable materials contained therein.

11. An apparatus as recited in claim 1 wherein at least one fork of the pair of forks of the lifting apparatus being rotatably mounted to the lifting carriage of the lifting apparatus for selectively and simultaneously securing at least one of the apertures thereon and thereto.

12. An apparatus as recited in claim 11 wherein the actuator means further includes a linear actuator that is selectively powered and the fork and its associated locking arm are selectively and simultaneously operated by the actuator means for securing the support frame assembly thereon and thereto.

13. An apparatus as recited in 12 wherein the locking arm is L-shaped with one leg of the L-shaped locking arm being journalled in a housing member for allowing rotary movement of the other leg of the L-shaped locking arm between the engaged position and disengaged.

14. An apparatus as recited in 11 wherein the locking arm is L-shaped with one leg of the L-shaped locking arm being journalled in a housing member for allowing rotary movement of the other leg of the L-shaped locking arm between the engaged position and disengaged.

15. An apparatus as recited in claim 1 wherein at least one fork of the pair of forks of the lifting apparatus being rotatably mounted to the lifting carriage of the lifting apparatus for selectively and simultaneously securing at least one of the apertures thereon and thereto and each of the apertures being arrayed interior of an elongated support rail of the support frame assembly.

16. An apparatus as recited in 15 wherein the actuator means further includes a linear actuator that is selectively powered and the fork and its associated locking arm are selectively and simultaneously operated by the actuator means for securing the support frame assembly thereon and thereto.

17. An apparatus as recited in 15 wherein the locking arm is L-shaped with one leg of the L-shaped locking arm being journalled in a housing member for allowing rotary movement of the other leg of the L-shaped locking arm between the engaged position and disengaged.

18. An apparatus as recited in 1 wherein the locking arm is L-shaped with one leg of the L-shaped locking arm being journalled in a housing member for allowing rotary movement of the other leg of the L-shaped locking arm between the engaged position and disengaged.

19. An apparatus as recited in claim 1 wherein said article to be lifted is a container for selectively blending and dispensing of flowable materials contained therein.

* * * * *